US007255348B1

(12) United States Patent
Shaffer

(10) Patent No.: US 7,255,348 B1
(45) Date of Patent: Aug. 14, 2007

(54) CATASTRAPHE

(76) Inventor: Jake Shaffer, 4208 Cottman Ave., Philadelphia, PA (US) 19136

( * ) Notice: Subject to any disclaimer, the term of this patent is extended or adjusted under 35 U.S.C. 154(b) by 53 days.

(21) Appl. No.: 11/136,694

(22) Filed: May 23, 2005

Related U.S. Application Data

(60) Provisional application No. 60/601,505, filed on Aug. 16, 2004.

(51) Int. Cl.
*A63F 3/00* (2006.01)

(52) U.S. Cl. ..... 273/243; 273/287

(58) Field of Classification Search ..... 273/243, 273/236, 287; D21/145, 146, 363–366, 369
See application file for complete search history.

(56) References Cited

U.S. PATENT DOCUMENTS

| | | | | |
|---|---|---|---|---|
| D108,424 | S * | 2/1938 | Clary | D21/366 |
| 2,238,829 | A * | 4/1941 | Schoonderwoerd et al. | 273/248 |
| 3,843,131 | A | 10/1974 | Stubbmann | |
| 4,030,762 | A * | 6/1977 | Gilmore | 273/248 |
| 4,049,275 | A | 9/1977 | Skelton | |

* cited by examiner

*Primary Examiner*—Vishu K. Mendiratta

(57) ABSTRACT

A board game for two to eight people to play. The board game utilizes eight separate colored zones for each player, a pair of dice, four game pieces per player, a circular path with game spaces, and an ultimate goal of each player parking their game pieces on four distinctly defined ending points.

5 Claims, 2 Drawing Sheets

CATASTRAPHE

I. CROSS-REFERENCE TO RELATED APPLICATIONS

This application claims the benefit of U.S. Provisional Application No. 60/601,505, filed Aug. 16, 2004.

II. BACKGROUND OF THE INVENTION

The present invention concerns that of a new and improved board game for two to eight people to play.

III. DESCRIPTION OF THE PRIOR ART

U.S. Pat. No. 3,843,131, issued to Stubbman, discloses a game comprised of a board with a central die agitating chance assembly used to determine how the pieces are moved.

U.S. Pat. No. 4,030,762, issued to Gilmore, discloses a board game having a octagon shaped path with a plurality of transverse routes.

U.S. Pat. No. 4,049,275, issued to Skelton, discloses a hexagon shaped board game having outer an inner tracks in which players move pieces based on the throw of dice.

IV. SUMMARY OF THE INVENTION

The present invention concerns that of a new and improved board game for two to eight people to play. The board game utilizes eight separate colored zones for each player, a pair of dice, four game pieces per player, a circular path with game spaces, and an ultimate goal of each player parking their game pieces on four distinctly defined ending points.

There has thus been outlined, rather broadly, the more important features of a board game that the detailed description thereof that follows may be better understood and in order that the present contribution to the art may be better appreciated. There are, of course, additional features of the board game that will be described hereinafter and which will form the subject matter of the claims appended hereto.

In this respect, before explaining at least one embodiment of the board game in detail, it is to be understood that the board game is not limited in its application to the details of construction and to the arrangements of the components set forth in the following description or illustrated in the drawings. The board game is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present board game. It is important, therefore, that the claims be regarded as including such equivalent constructions insofar as they do not depart from the spirit and scope of the present invention.

It is therefore an object of the present invention to provide a board game which has all of the advantages of the prior art and none of the disadvantages.

It is another object of the present invention to provide a board game which may be easily and efficiently manufactured and marketed.

It is another object of the present invention to provide a board game which is of durable and reliable construction.

It is yet another object of the present invention to provide a board game which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
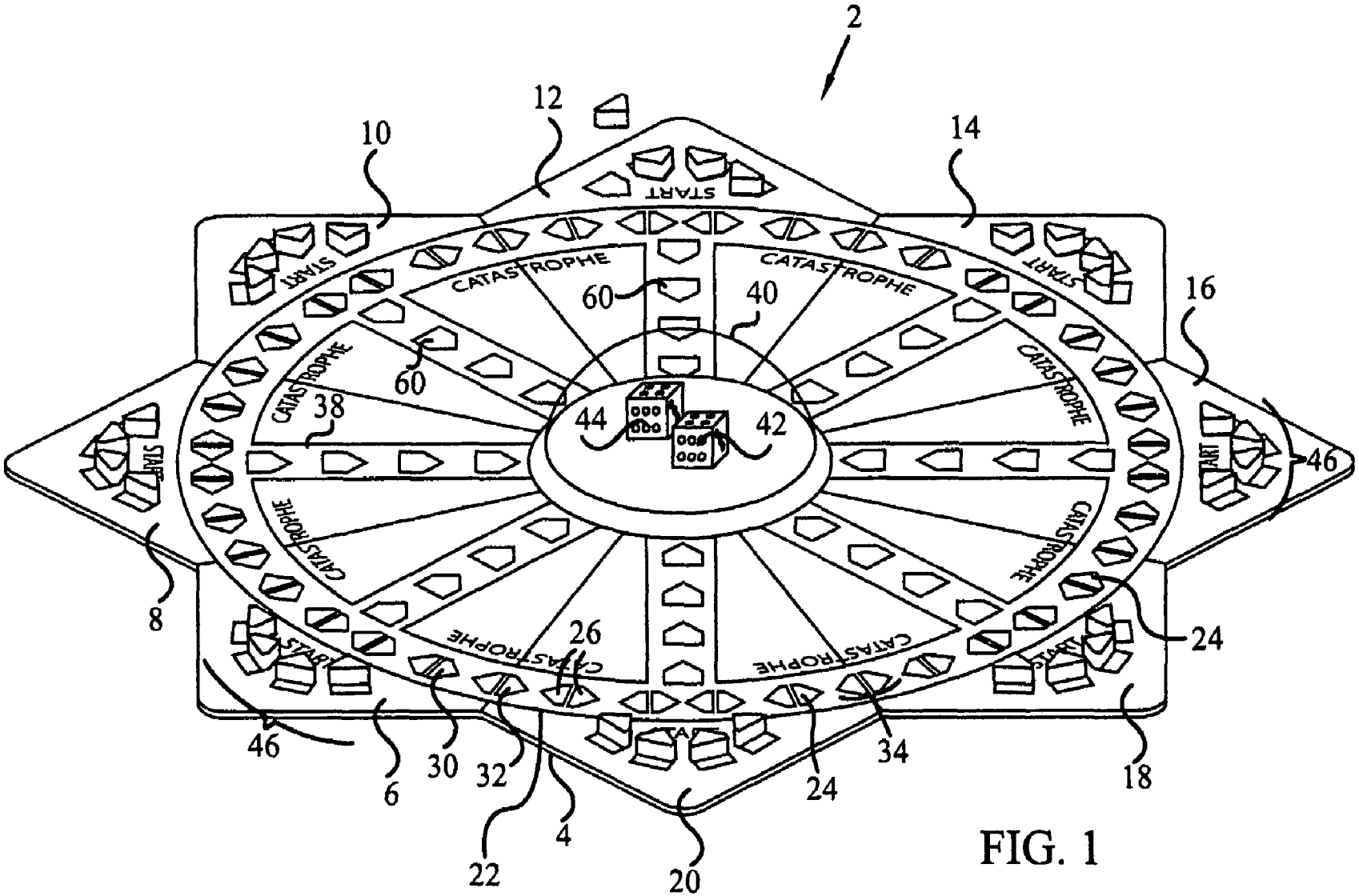
FIG. 1 shows a perspective view of the game board used with the present invention.

FIG. 1 shows a perspective view of the game board 4 used with the board game 2 of the present invention. Game board 4 is designed to be shaped like an eight-pointed star, with the game board 4 having two surfaces, a top surface and a bottom surface.

The top surface of game board 4 is divided into eight separate zones, with each zone having a separate color. Starting at the red zone 6 and moving in a clockwise manner, the remaining zones are in the following order: the yellow zone 8, the purple zone 10, the blue zone 12, the pink zone 14, the black zone 16, the orange zone 18, and the green zone 20. Each player that is playing the board game 2 would utilize one zone. Each "point" on the eight-pointed star of the game board 4 is in the middle of that particular zone.

The top surface of the game board 4 has a circular path 22 superimposed on it, with the circular path 22 including a plurality of spaces 24 on which game play will occur. The circular path itself is designed to be white. Each of the spaces on a particular zone will have the same color as the zone in which they are located.

Each of the spaces 24 is fabricated from two triangles 26 pressed against each other. Each of the zones on the game board 4 have four complete spaces 30 and two half-spaces 32, with each half-space 32 essentially being a space that is located on a border with an adjacent zone. For each half-space 32, one of the triangles 26 has the color of the included zone, and the other triangle has the color of the adjacent zone. Each of these "hybrid" spaces 34 have the same shape as that of the regular spaces 26, except each one has two differently colored triangles.

Each of the zones has a "spoke" 38 that connects the circular path 22 to the middle of the game board 4, where a dice-popping mechanism 40 is located. Each spoke 38 has four inner spaces 60 within it leading up to the dice-popping mechanism 40. Within the dice-popping mechanism 40 is located a pair of dice 42 and 44, with each die having six faces with numbers one through six engraved on them.

Each zone has four accompanying game pieces 46, with each game piece 46 for a particular zone having the same color as that zone. Prior to game play, the game pieces 46 for each particular zone would be placed in the area within the proper zone outside the perimeter of the circular path 22. Each of the game pieces 46 has a top surface and a bottom surface, and furthermore, has five "sides" which form the perimeter of the game piece 46, with two of the sides resembling a pointer arrow.

Figure 2:
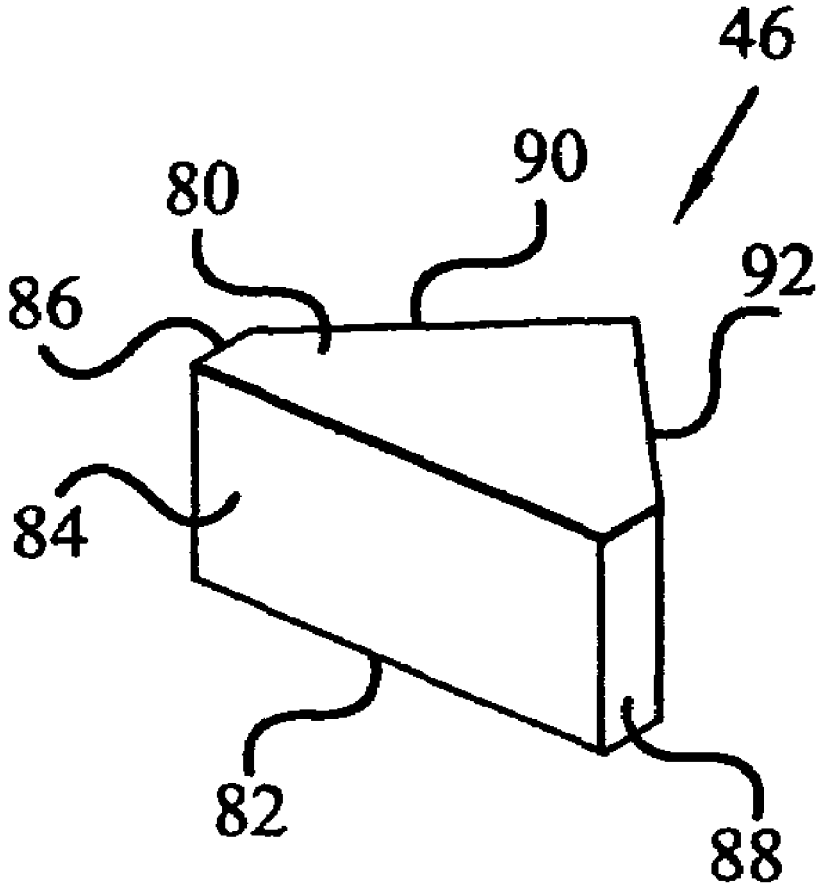
FIG. 2 shows a perspective view of a game piece.

FIG. 2 shows a perspective view of a game piece 46. Game piece 46 has a top surface 80, a bottom surface 82, and five "sides" which form the perimeter of the game piece 46. Base side 84 has two ends, a first end and a second end. Left side 86 and right side 88 each have two ends, a first end and a second end. The first end of the left side 86 is attached to the first end of the base side 84, while the first end of the right side 88 is attached to the second end of the base side 84. Upper left side 90 and upper right side 92 each have two ends, a first end and a second end, with the first end of the upper left side 90 diagonally connected to the second end of the left side 86 and the first end of the upper right side 92 diagonally connected to the second end of the right side 88. The second end of the upper left side 90 and the second end of the upper right side 92 meet each other and form a pointer 94 that serves as a directional marker for an individual to use in this game.

The rules of the game are as follows:

1. The youngest player goes first and then the play proceeds counterclockwise from this first player.
2. A "roll" of seven is needed to get a player's first playing piece out of the start area and onto the board where play proceeds in a clockwise direction on the spaces 24 around the circular path 22. Each game piece 46 "enters" the game board by placing it on the right-most solid-color space 24 on a particular player's zone. Once a seven is actually obtained, a game piece 46 is entered onto the board but is not moved until subsequent turns by that player.
3. Each player gets one dice "roll," per turn, by activating the dice-popping mechanism 40.
4. Once a player has at least one game piece 46 on the circular path 22 and they have subsequent turns, any roll of the dice totaling other than seven requires the player to move one of the pieces 46 already on the circular path 22. Any roll of the dice totaling seven requires the player to take one of the player's game pieces 46 not currently in play and place in on the circular path 22 (unless all of the player's pieces 46 are already on the board, in which case, the player can decide which piece 46 to move seven spaces).
5. Pieces 46 are initially to be moved around in a clockwise manner on the spaces 24 on the circular path 22. If an individual has more than one game piece 46 already on the circular path 22, then an individual can choose to move only one of the game pieces 46 after rolling the dice for each particular turn.
6. Up to two game pieces 46 can remain on a particular space 24.
7. Because each space 24 is fabricated from two triangles 26 that point in opposite directions, game piece 46 shall be placed on the triangle in a manner such that the point 94 on the game piece indicates the direction in which the piece 46 will be moved when it is next moved.
8. If any time during play a second piece 46 finishes a turn on a space 24 on which a first game piece 46 is already located, both pieces can remain. However, the direction of the first game piece 46 shall be changed so that the next time it is moved, it will be played in a counterclockwise direction. This direction shall continue for this first game piece 46 until it once again is altered by this same mechanism or by another mechanism within the game.
9. If at any time during game play a player rolls "doubles," which means that the numbers on each of the two die are the same, whatever game piece 46 the player decides to move shall switch directions and be moved in a counterclockwise manner until altered by this same mechanism or by another mechanism within the game.
10. If any time during play a third piece 46 finishes a turn on a space 24 on which both a first piece 46 and a second piece 46 are already located, the first piece 46 and the second piece 46 shall be sent back to their respective starting areas within the respective zones. The third piece 46 shall then continue play in a clockwise manner when subsequently moved on a future turn.
11. The first player to win the game is the first player to get all four of their game pieces 46 onto the four inner spaces 60 within the spoke 38 that is in their zone. A player can move a game piece 46 onto an inner space 60 in the spoke 38 on a turn of theirs only if (a) the piece has moved at least one full revolution in a clockwise manner around the circular path 22, (b) the piece is moving clockwise, (c) the player can place the piece 46 on one of the inner spaces 60 with an exact match.

What I claim as my invention is:

1. A board game comprising:

a game board having a top surface and a bottom surface, the game board being shaped like an eight-pointed star, eight separate zones placed on the top surface of the game board, each of the zones having four complete spaces and two one-half spaces, each half-space being a space that is located on a border with an adjacent zone, each of the spaces being the same size and shape, a circular path superimposed on the top surface of the game board, the circular path including a plurality of spaces, the circular path being white, each of the spaces on the circular path having the same color as the zone in which they are located, a dice-popping mechanism located in the middle of the top surface of the game board, the dice-popping mechanism comprising a pair of dice, each dice having six sides, the numbers one through six being engraved on each side of the dice, a plurality of spokes, each zone having one spoke, each spoke connecting the circular path to the dice-popping mechanism in the middle of the game board, a plurality of game pieces, each game piece having a top surface and a bottom surface, each game piece having five sides comprising a base side, a left side, a right side, an upper left side, and an upper right side, the base side of each game piece being the same size and shape as a half space, wherein each half-space has a triangle with the color of the included zone and another triangle with a color of the adjacent zone, and a set of predetermined rules for playing the board game.

2. A board game according to claim 1 wherein each space is fabricated from two triangles pressed against one another.

3. A board game according to claim 1 wherein each spoke has a quartet of inner spaces in them.

4. A board game according to claim 1 wherein the set of predetermined rules for playing the board game further comprises:

allowing the youngest player to proceed first, commencing play by having each player engage the dice-popping mechanism, having each player, upon rolling a combined total of seven on the two dice, taking a playing piece out of the start area onto the board where play proceeds in a clockwise direction around the board in a clockwise direction, wherein each piece "entering" the board is placed on the right-most solid-color space on a particular player's zone, having each player take one dice roll per turn, having each player, upon receiving any dice roll other than seven, move one of their game pieces already on the board around the circular path in a clockwise direction, having each player, upon receiving a dice roll of seven, move one of the game pieces not in play and place it onto the game board, playing each piece at least one full revolution of the game board on the circular path, moving each piece onto an inner space within the spoke that is in their zone after each respective piece has been moved around at least one full revolution on the circular path, further wherein each piece can be moved onto the inner space within the spoke that is in their zone only if it is moving clockwise, and further wherein each piece can be moved onto the inner space within the spoke that is in their zone only if it is an exact match with the total on the rolled dice within the dice-popping mechanism.

5. A game board according to claim 1 wherein the eight separate zones include a red zone, a yellow zone, a purple zone, a blue zone, a pink zone, a black zone, an orange zone, and a green zone.

* * * * *